United States Patent [19]

Shull

[11] Patent Number: 4,531,649

[45] Date of Patent: Jul. 30, 1985

[54] MOLDED PLASTIC CAP WITH SEALING LINER

[75] Inventor: Robert W. Shull, Lancaster, Ohio

[73] Assignee: Anchor Hocking Corporation, Lancaster, Ohio

[21] Appl. No.: 602,686

[22] Filed: Apr. 23, 1984

[51] Int. Cl.[3] ..... B65D 53/04

[52] U.S. Cl. ..... 215/232; 215/342; 215/347; 215/351; 215/DIG. 1

[58] Field of Search ..... 215/232, 329, 341, 342, 215/349, 351, DIG. 1

[56] References Cited

U.S. PATENT DOCUMENTS

| | | | |
|---|---|---|---|
| 1,978,946 | 10/1934 | Horner | 215/351 X |
| 4,013,188 | 3/1977 | Ray | 215/349 X |
| 4,121,729 | 10/1978 | Husum | 215/342 X |
| 4,390,552 | 6/1983 | Niwa | 215/232 X |

FOREIGN PATENT DOCUMENTS

| | | | |
|---|---|---|---|
| 933489 | 9/1973 | Canada | 215/349 |
| 955886 | 10/1974 | Canada | 215/DIG. 1 |
| 850871 | 9/1939 | France | 215/351 |

*Primary Examiner*—Donald F. Norton

*Attorney, Agent, or Firm*—Stoll, Wilkie, Previto & Hoffman

[57] ABSTRACT

A molded plastic closure cap has a number of downwardly projecting fins on the underside of its cover for forming a seal with a container in combination with a liner positioned between the fins and the container rim. The liner is a laminated one consisting of a plastic foam layer engaging the fins, an adhesive layer engaging the package and a thin aluminum foil layer sandwiched between the foam layer and the adhesive layer.

15 Claims, 8 Drawing Figures

Fig. 1.
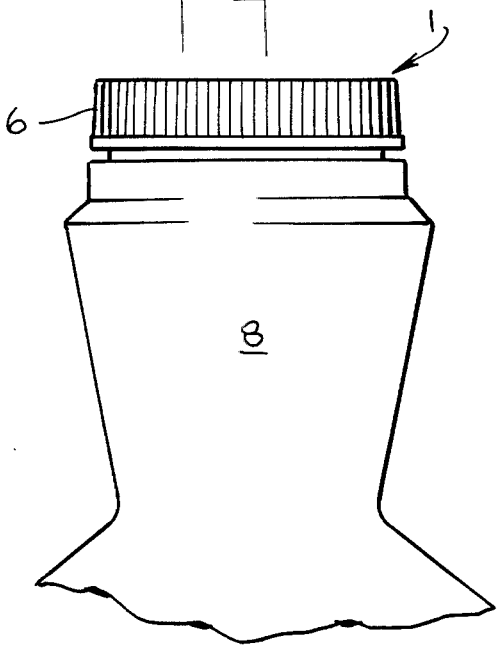
Fig. 2.
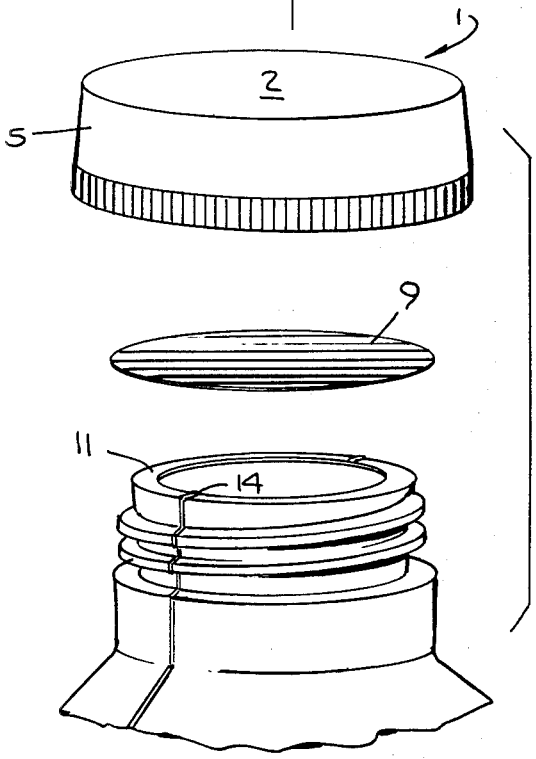
Fig. 3.
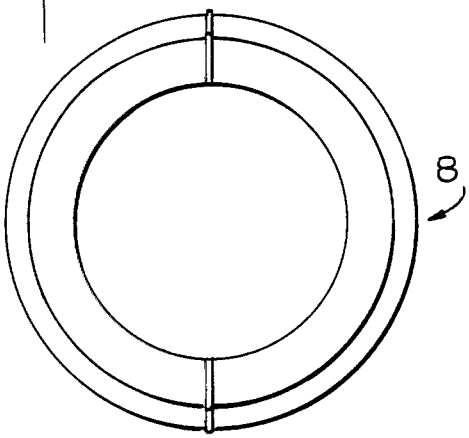
Fig. 5.
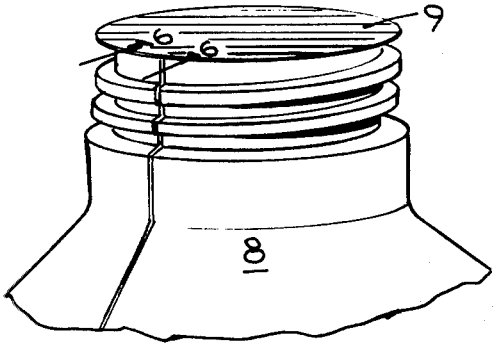
Fig. 6.
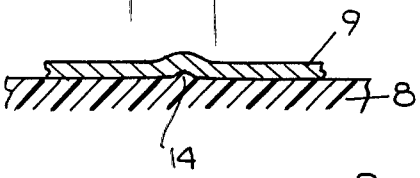
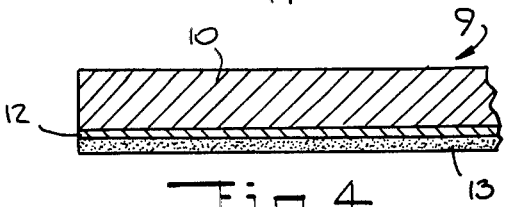
Fig. 4.

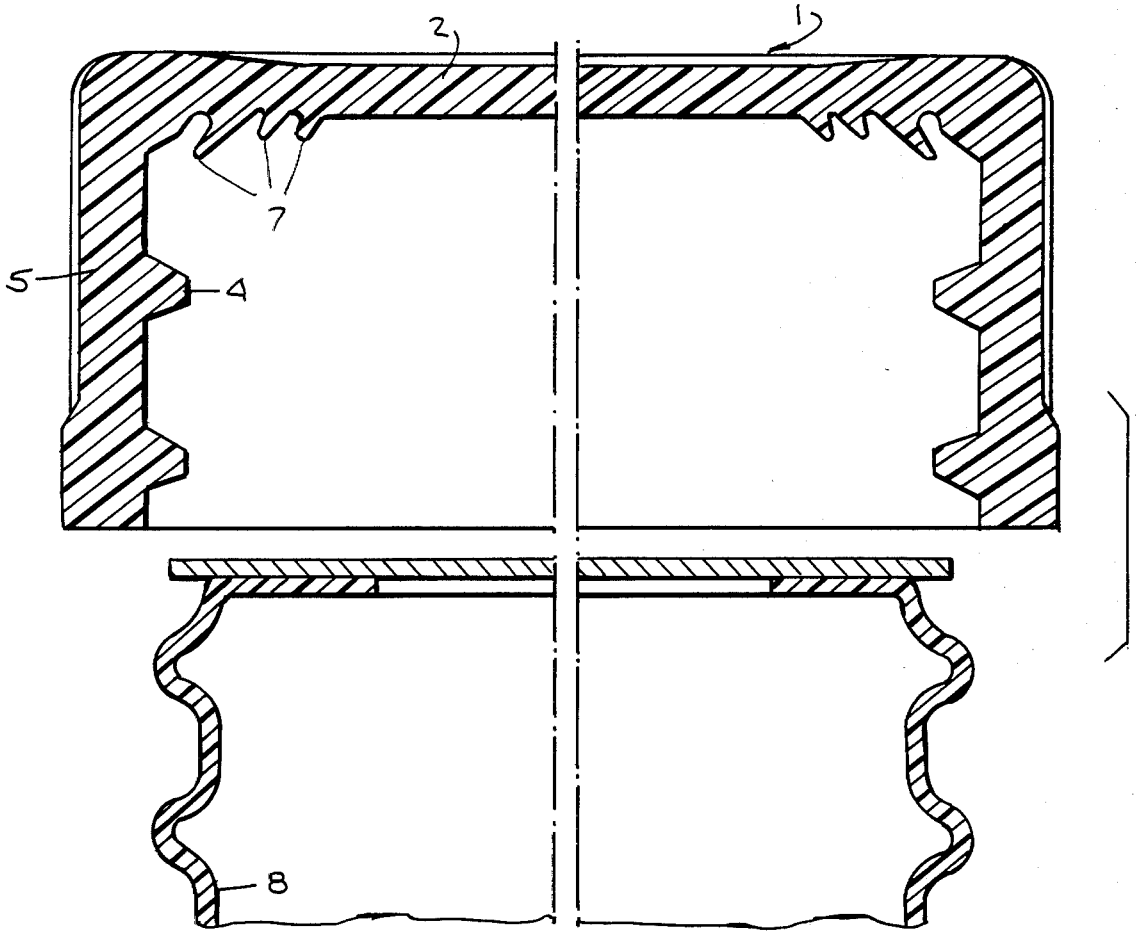
Fig. 7.
Fig. 8.
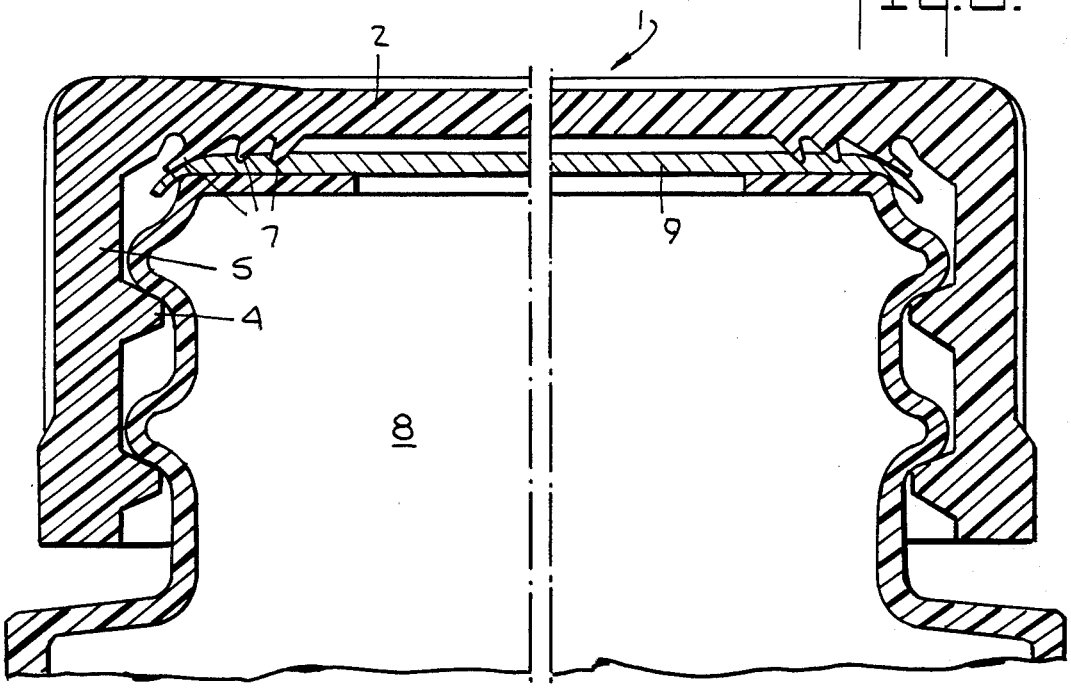

MOLDED PLASTIC CAP WITH SEALING LINER

BACKGROUND OF THE INVENTION

The present invention relates to a molded plastic closure and in particular to such a closure having a sealing means comprising molded plastic fins and a laminated cap liner. More particularly, the closure includes a downwardly projecting fin means having a generally triangular cross-section on which a laminated liner including a plastic layer is positioned. The seal is made between the liner and the package rim with the plastic closure ribs engaging a resilient layer on the liner for pressing the liner into tight sealing engagement with the container rim.

There are a number of molded closures using differently shaped and positioned fins for sealing containers such as glass and plastic bottles and the like. Such caps have been found to seal effectively on containers having relatively smooth rims or sealing finishes. There are, however, a number of containers and particularly thin molded plastic containers which are formed with significant mold marks or mold lines which extend over the package rims or sealing surfaces. Difficulty has been encountered in obtaining an inexpensive closure of the plastic type for effectively sealing these containers such as for forming an air tight seal on such packages. The fin and liner design in accordance with the present invention overcomes this problem and provides for an effective, easily applied, closure for sealing this and other packages.

Accordingly, an object of the present invention is to provide an improved molded plastic closure and liner combination.

Another object of the present invention is to provide an improved closure for sealing containers with projections on the container rim or sealing surface.

Another object of the present invention is to provide a molded plastic closure with a liner for sealing containers having uneven or marked sealing surfaces.

Another object of the present invention is to provide an improved, inexpensive plastic closure with liner for sealing on irregular surfaces.

Other and further objects of the present invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a side elevational view of a package sealed with the closure of the invention.

FIG. 2 is an exploded perspective view of the closure of the invention and a package to be sealed by the closure.

FIG. 3 is a top plan view of the package of FIG. 2.

FIG. 4 is an enlarged framentary cross-sectional view of a liner in accordance with the present invention.

FIG. 5 is a perspective view of a liner in accordance with the invention applied to a container.

FIG. 6 is a sectional view taken along line 6—6 on FIG. 5.

FIG. 7 is an enlarged sectional view of the closure and liner with a typical package.

FIG. 8 is an enlarged cross-sectional view of a package sealed with the closure of the invention.

DESCRIPTION OF THE PREFERRED EMBODIMENT

The molded portion of the plastic closure 1 comprises a cover 2 and a depending skirt 5 with the container engaging threads 4 molded on the inner surface of the closure skirt 5. Suitable gripping knurls 6 are formed on the upper portion of the cap skirt 5. A number of downwardly projecting sealing fins 7 are provided on the underside of the cap cover 2. In the preferred embodiment, the fins comprise a number of fins 7 having a generally triangular cross-section with the pointed ends being positioned lowermost. The radially outermost of the sealing fins 7 preferably slants outwardly such as about at a 45° angle to the vertical and is so positioned that its lowermost portion is positioned above the corner of the container 8 being sealed. The additional and radially inner ribs are shorter and have a generally corresponding angle with respect to the vertical.

As will be described below, the sealing fins 7 cooperate with applicant's preferred sealing liner 9 in the initial sealing of the container 8. This cooperation is provided by the partial penetration of the fins 7 into the upper surface of the sealing liner 9 and particularly into a soft upper layer 10 of the liner 9. The sealed position of the package is best illustrated in FIGS. 1 and 8 and particularly in FIG. 8 where the position of the sealing liner 9 on the container 8 finish 11 is illustrated together with the engagement of the sealing fins 7 with the liner 9. The larger fin 7 is imbedded in the liner 9 forcing it over the edge of the container 8 finish 11. The closure cap 1 is tightly held in this sealed position as its threads 4 engage cooperating threads 12 formed at the neck of the container 8.

The preferred liner 9 has a laminated construction preferably comprising three layers. The uppermost layer 10, as illustrated in FIG. 4 is soft plastic foam such as a polystyrene foam. This layer having a depth about 0.02 inches is applied over a thin paper backed aluminum foil layer 12 of about 0.0035 inches. The lowermost layer 13 is an adhesive layer utilizing a heat sensitive adhesive such as 1.5 to 3.0 mils. of high molecular weight ethylene and vinyl acetate copolymers, or a pressure sensitive adhesive which adheres the liner 9 tightly to the top of the container finish 11 as illustrated in FIGS. 5 through 8. The liner 9 may be pre-assembled within the closure 1 so that it is applied at the same time as the closure 1. Where a heat sealing liner is used, the heat is applied after the cap has been screwed onto the container as through induction heating.

When the cap 1 is removed, the liner 9 remaining attached to the container 8 and is exposed to the user. After the liner 9 has been torn off, the package 8 may be resealed taking advantage of the seal provided between the molded plastic fins 7 and the container rim 11.

The closure 1 with the liner 9 is particularly effective in sealing containers having slight imperfections on their sealing surface, such as illustrated by a line or flaw at 14 in FIGs. 2 and 6. The molded plastic container 8 has a part or mold line 14 formed during the container formation. The line 14 inteferes with proper seals in the case of most closures, however, its adverse sealing effects are overcome using the closure 1 through the combined action of the liner 9 and the ribs 7 in the manner illustrated in FIG. 6. The same advantages are obtainable with containers other than the thin walled molded container 8 illustrated as the combination of the cap 1 and liner 9 as described overcomes minor flaws or other uneven surfaces at the container rim 11.

It will be seen that an improved closure cap has been provided comprising the combination of a molded closure cap with sealing fins and a cooperating laminated liner. The cap is particularly effective in the sealing of containers wherein irregularities at the sealing surface result from the method of container manufacture or from minor imperfections in the container as manufactured.

As various changes may be made in the form, construction and arrangement of the invention and without departing from the spirit and scope of the invention, and without sacrificing any of its advantages, it is to be understood that all matter herein is to be interpreted as illustrative and not in a limiting sense.

Having thus described my invention, I claim:

1. An improved closure cap for forming a seal on a container sealing surface including an irregular sealing surface of a container comprising the combination of a molded closure shell having a cover and a depending skirt with container engaging thread means on the interior of said skirt, and a downwardly projecting sealing fin means molded integrally with the shell on the underside of the shell cover, and a sealing liner positioned within said shell for engaging the container sealing surface with its lower surface and the sealing fin means with its upper surface, said sealing fin means comprising a plurality of circular fins with a radially outermost fin being larger than the remaining fin or fins and being flared outwardly and positioned to force the outer edge of said sealing liner around the corner of the container finish, and said sealing liner comprising a plurality of layers including a soft plastic layer for engaging said sealing fin means and an adhesive bottom layer for adhering the liner to the container finish.

2. The closure cap as claimed in claim 1 in which said soft plastic layer comprises polystyrene.

3. The closure cap as claimed in claim 1 which said soft plastic layer comprises foam plastic.

4. The closure cap as claimed in claim 1 in which said sealing liner comprises an uppermost foam plastic layer, an intermediate aluminum foil layer, and a lowermost adhesive layer.

5. The closure cap as claimed in claim 1 in which said adhesive bottom layer comprises a heat sensitive layer.

6. The closure cap as claimed in claim 1 in which said adhesive bottom layer comprises a layer of high molecular weight ethylene and vinyl acetate copolymers.

7. The closure cap as claimed in claim 1 in which said adhesive layer comprises a pressure sensitive adhesive.

8. A sealed package comprising the combination of a container having an irregular sealing surface, a molded closure shell having a cover and a depending skirt with container engaging thread means on the interior of said skirt engaging threads on the container, a downwardly projecting sealing fin means molded integrally with the closure shell on the underside of the shell cover, and a sealing liner positioned within said shell engaging the container sealing surface with its lower surface and the sealing fin means with its upper surface, said sealing fin means comprising a plurality of fins with the radially outermost fin being larger than the remaining fin or fins and being flared outwardly and forcing the outer edge of said sealing liner around the corner of said container finish, and said sealing liner comprising a plurality of layers includiing a soft plastic layer for engaging said fin means and an adhesive bottom layer for adhering the liner to the container finish.

9. The package as claimed in claim 8 in which said soft plastic layer comprises polystyrene.

10. The package as claimed in claim 8 in which said soft plastic layer comprises foam plastic.

11. The package as claimed in claim 8 in which said sealing liner comprises an uppermost foam plastic layer, an intermediate aluminum foil layer, and a lowermost adhesive layer.

12. The package as claimed in claim 8 in which said adhesive bottom layer comprises a heat sensitive layer.

13. The package as claimed in claim 8 in which said adhesive bottom layer comprises a layer of high molecular weight ethylene and vinyl acetate copolymers.

14. The package as claimed in claim 8 in which said adhesive layer comprises a pressure sensitive adhesive.

15. The package as claimed in claim 8 in which said container comprises molded plastic.

* * * * *